United States Patent [19]

Spiegel

[11] 4,035,927

[45] July 19, 1977

[54] PORTABLE CLOTHES DRYER

[76] Inventor: Jack Spiegel, 80 Van Courtlandt Park South, Bldg. No. 7E, Bronx, N.Y. 10463

[21] Appl. No.: 665,778

[22] Filed: Mar. 10, 1976

[51] Int. Cl.[2] ..... F26B 9/00

[52] U.S. Cl. ..... 34/163; 34/201; 34/151; 34/233

[58] Field of Search ..... 34/90, 91, 201, 151, 34/163, 239–241, 202, 88, 233, 231

[56] References Cited

U.S. PATENT DOCUMENTS

| | | | |
|---|---|---|---|
| 2,463,218 | 3/1949 | Travis | 34/163 |
| 2,479,706 | 8/1949 | Williams | 34/163 |
| 2,752,694 | 7/1956 | McCormick | 34/88 |
| 2,834,122 | 5/1958 | Ashworth | 34/163 |
| 3,892,047 | 7/1975 | Muller-Scherak | 34/103 |

*Primary Examiner*—Kenneth W. Sprague
*Assistant Examiner*—James C. Yeung

[57] ABSTRACT

A portable dryer for drying articles of clothing includes a rigid housing formed with openings near its bottom, attachment means located near the top of the housing for securing at least one external drying means thereto for operatively supplying heated air into the housing. Heated air operatively received from the hair dryer in the housing and passing therethrough is expelled from the housing through the openings.

8 Claims, 1 Drawing Figure

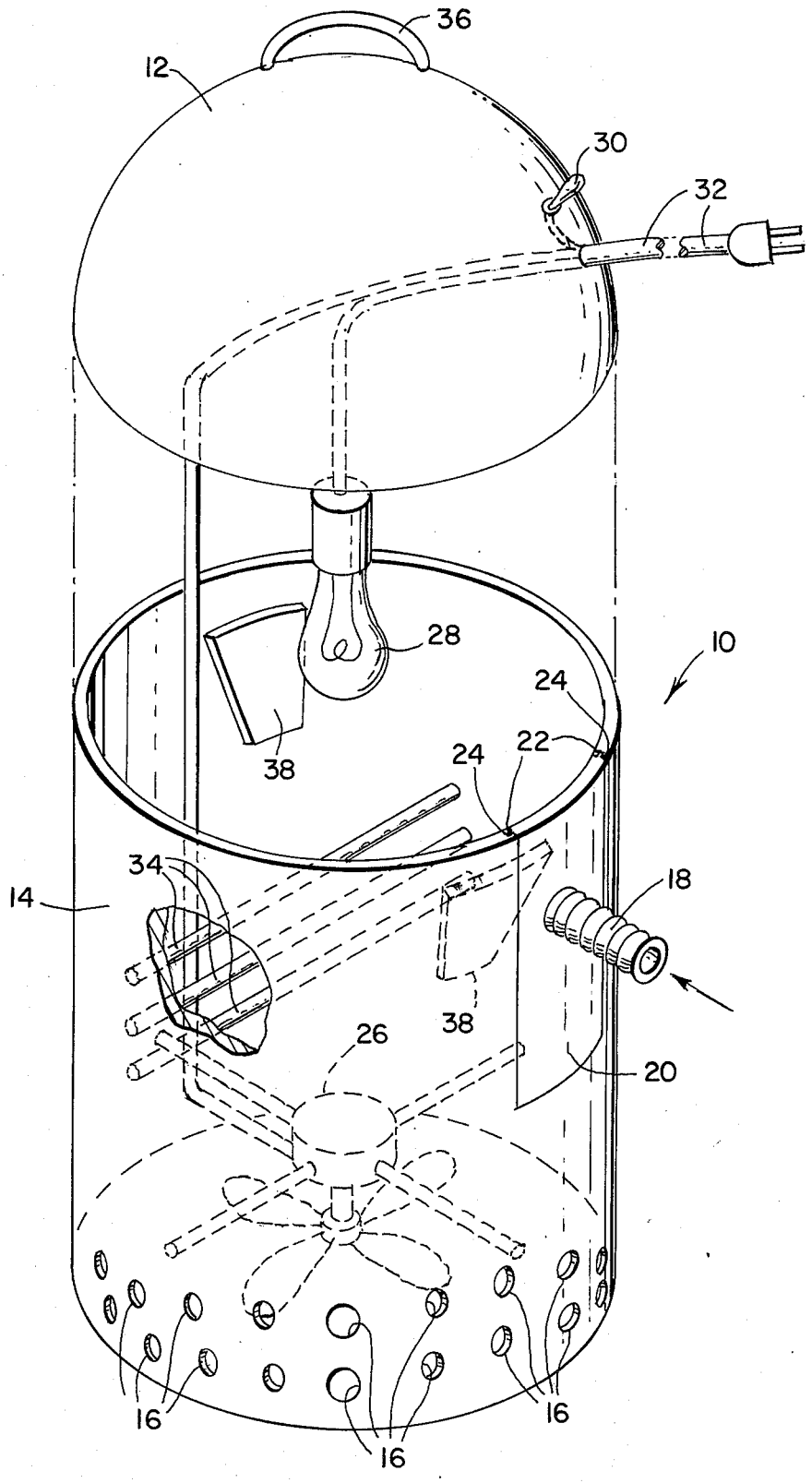
36
12
30
32
28
10
24
22
24
38
34
14
18
38
26
20
16
16
16

PORTABLE CLOTHES DRYER

BACKGROUND OF THE INVENTION

1. Field of the Invention

The field of the invention relates to a portable dryer for articles of clothing.

2. Description of the Prior Art

Clothes dryers are known which employ electric fans and heating means to generate a blast of hot air by means of which articles of clothing disposed within the dryer are dryable; although such dryers operate in a self-contained manner, they fail to take advantage of the fact that the owner of the dryer may already be in possession of other drying means, such as hair dryers, which could be advantageously employed in a clothes dryer, thus minimizing its acquisition cost.

SUMMARY OF THE INVENTION

It is accordingly an object of the present invention to devise a clothes dryer which, while drying articles of clothing efficiently, makes provision to use any already available drying means, such as hair dryers, to reduce the acquisition cost of the dryer.

I accordingly provide a portable dryer for drying articles of clothing, which includes a rigid housing having a top and a bottom and which is formed with openings near the bottom, attachment means located near the top of the housing for securing at least one external drying means thereto for operatively supplying heated air into the housing, and an electrically operable exhaust fan disposed within the housing. Heated air operatively received from the drying means in the housing and passing therethrough is expelled therefrom through the openings.

For additional efficiency a heat source may be disposed within the housing for incrementally heating the air supplied by the drying means to the housing, which may, for example, be a light bulb. The drying means is preferably a hair dryer, and the attachment means is preferably a hose. It will be advantageous to provide a switch on the portable dryer for switching the exhaust fan, as well as the additional optional heating means on, and off. Any wear and tear of the hose can be advantageously taken care of by providing a panel insertable into the housing, the hose being attached to the panel, so that the panel together with the hose is replaceable; the housing is preferably formed with grooves and the panel with tongues for the panel to be easily insertable with its tongues into the grooves formed in the housing.

Where the hair dryer is attached to the housing so as to blow air horizontally thereinto, it is advantageous to provide deflector plate means for deflecting the air onto articles of clothing disposed within the dryer, the articles of clothing being preferably disposed on a clothes rack provided within the housing. The top of the dryer is preferably detachable from a cylindrical portion of the housing for easy access for the articles of clothing.

BRIEF DESCRIPTION OF THE DRAWING

My invention will be better understood with reference to the sole accompanying FIGURE of the drawing which shows a perspective view of the portable clothes dryer according to my invention.

DESCRIPTION OF THE PREFERRED EMBODIMENT

Referring now to the drawing, a portable clothes dryer 10 having a rigid housing has a top portion 12, and a substantially cylindrical portion 14, the top portion 12 being detachable from the latter. The housing of the clothes dryer 10 is formed with openings 16 near the bottom thereof. Attachment means for external drying means, preferably in the form of a flexible hose 18, are provided on the housing of the clothes dryer 10. The hose 18 is preferably attached to a panel 20, which is formed with tongues 22 insertable into corresponding grooves 24 formed in the housing. An electrically rotatable exhaust fan 26 is disposed near the bottom of the housing to aid in expelling the hot air furnished by the external drying means through the openings 16; the external drying means may, for example, be a non-illustrated hair dryer. The heat generated by the external drying means may be optionally augmented by internal heating means 28, e.g. a light bulb, disposed within the hair dryer. Both the internal heating means 28 and the fan 26 may be switched on and off by switching means 30 disposed on the clothes dryer, the switching means being connectable to an external electric supply by means of a cord 32. Articles of clothing are advantageously disposed on a clothing rack 34 located within the portable dryer. For easy access of the articles of clothing the portable dryer, according to my invention, is preferably provided with a handle 36 located on the generally semi-spherical top portion 12, the latter being attachable to the cylindrical portion 14.

Where the hair dryer supplies air in a horizontal stream, it will be advantageous to provide deflector plates 38 disposed within the housing of the clothes dryer 10, to deflect the incoming heated air onto the articles of clothing disposed on the clothing rack 34.

Although the invention has been described with respect to a preferred form thereof, it is to be understood that it is not to be so limited since changes can be made therein which ae within the full intended scope of this invention as defined by the appended claims.

What is claimed is:

1. A portable dryer for drying articles of clothing comprising:

a rigid housing having a top and a bottom and formed with openings near said bottom;

a hose located near the top of said housing for securing at least one external hair dryer thereto for operatively supplying heated air into said housing;

a panel insertable into said housing, said hose being attachable to said panel; and an electrically operable exhaust fan disposed within said housing, whereby heated air operatively received from the hair dryer in said housing and passing therethrough is expelled therefrom through said openings.

2. A portable dryer according to claim 1 further comprising heat source means disposed within said housing incrementally heating the air supplied by the drying means to said housing.

3. A portable dryer according to claim 2 further comprising switch means for switching said exhaust fan and said heat source means on and off.

4. A portable dryer according to claim 3 further comprising clothes rack means located within said housing for disposing the articles of clothing thereonto.

5. A portable dryer according to claim 3 wherein said heat source means is a light bulb.

6. A portable dryer according to claim 1, wherein said housing is formed with a groove and said panel is formed with a tongue slidably insertable into said groove.

7. A portable dryer according to claim 1 further comprising deflector plate means for deflecting the heated air onto the articles of clothing.

8. A portable dryer according to claim 1, wherein said housing includes a substantially cylindrical portion and wherein said top is substantially hemispherical and detachable from said cylindrical portion.

* * * * *